United States Patent [19]

Affolder

[11] 4,327,996

[45] May 4, 1982

[54] APPARATUS FOR CONTROLLING THE MOVEMENT OF PRESS COMPONENTS

[75] Inventor: Steven L. Affolder, Berne, Ind.

[73] Assignee: CTS Corporation, Elkhart, Ind.

[21] Appl. No.: 183,256

[22] Filed: Sep. 2, 1980

[51] Int. Cl.[3] ..... B30B 11/02; B22F 3/02

[52] U.S. Cl. ..... 425/78; 425/168; 425/258; 425/406

[58] Field of Search ..... 425/78, 168, 256, 260, 425/258

[56] References Cited

U.S. PATENT DOCUMENTS

| | | | |
|---|---|---|---|
| 1,900,797 | 3/1933 | Cawood | 425/260 |
| 2,685,117 | 8/1954 | Rivers | 425/260 |

*Primary Examiner*—J. Howard Flint, Jr.
*Attorney, Agent, or Firm*—John A. Young; Larry J. Palguta

[57] ABSTRACT

In a press (10) for briquetting loose ceramic powders into cohesive compacted articles, a shuttle (24) and shoe (26) is employed for receiving an inflow of loose powders and adapted for filling the die cavity with powder. Simultaneously the shoe (26) displaces an ejected briquetted article. The characteristics of the longitudinal movement of the shuttle (24), including its range, speed, and phase of movement, are controlled by a power shaft having a crank shaft (50) coupled to the power shaft through an adjustable plate (39). The adjustable plate (39) is angularly adjusted, and the pivot connection (48) between the crank shaft (50) and the center (54) of the adapter plate (39) is radially adjusted. The described adjustments regulate the range, speed, and phase of movement of the shuttle (24). Between the crank shaft (50) and the shuttle (24) is a rocker shaft (60), rocker arms (66, 68) and struts (76).

The shuttle (24) may be biased against the press (10) by means of a power cylinder (86) and rod (87) which biases the shuttle (24) toward the platen surface (25) of the press (10).

5 Claims, 3 Drawing Figures

APPARATUS FOR CONTROLLING THE MOVEMENT OF PRESS COMPONENTS

DESCRIPTION

Technical Field

The present invention relates to compacting presses, and particularly to compacting presses in which loose powders are dispensed into a die cavity. Substantial compressive forces are then imposed on the loose powders within the die cavity, forming a compact self-supporting article which will hold the shape of the briquette until it is fired.

In the operation of the press, a shuttle (having a charging shoe) is periodically filled with loose powders. The shoe is then caused to overlie the die cavity furnishing sufficient loose powders to completely fill the die cavity. Thereafter the shuttle moves the shoe into a retracted position, the die is closed, a briquette is formed and then ejected from the die. The shuttle again moves, this time to displace the ejected briquette in an outlet direction, and to again overlie the die cavity and furnish additional powder so that the die is refilled and the briquetting operation is repeated.

2. Background Art

The present invention is utilized with a particular compacting press known as a Dorst Press. While no claims are made to the details of the compacting steps, the press which is utilized in the present invention, is prone to excessive wear because previously the shuttle movement was effected by a series of cams with exposed cam portions which tended to deteriorate in the presence of dust and powders which make up the briquette. Also the range of movement of the shuttle, its phase of movement, and speed were relatively uncontrollable.

DISCLOSURE OF THE INVENTION

In accordance with the present invention, an adjustable bell crank is provided between a power shaft, and a rocker shaft with a pair of rocker arms. The rocker arms in turn attach through a strut to a shuttle and shoe. The resulting mechanical movement of the shuttle is smooth in that there is a smooth transition as the shuttle reciprocates. The movements are sinusoidal in nature and, as a result, there is imposed less impact force on the press components. Additionally, because of the bell crank type connection between the power shaft and the shuttle, there is an opportunity to adjust the bell crank so that the range of shoe movement, the characteristics of the sinusoidal curve describing the movement, and the phase of movement, i.e., shifting the starting point and stopping point of the shuttle movement in relation to the other operational phases of the press, can be adjusted.

The improved drive mechanism consists of an adjustable bell crank with completely sealed bearing components fully capable of adjusting the shuttle movement, the characteristics of movement, and the phase of movement, all being in conjunction with sealed bearings which present less incidence of wear of the moving components of the press and thereby reducing service expense and down-time of the press. This is a particularly advantageous arrangement in that the press can be individually adjusted for dwell time, maximum degree of movement, smoothness of transition from static to maximum rate of movement and phase of actuation. All these parameters are relevant when changing the die cavity volume, the size of briquettes, and the speed of operation. Thus, a given press can be readily adjusted to accomodate for different sizes and characteristics of briquettes and the movement or the handling of the briquettes can be smoother and more gentle, thus reducing damage to the finished briquette.

As a result of the foregoing, the press can be run at a higher speed, and the relationship of quantity of powder to the weight of the finished briquette is a ratio which tends to remain more fixed and reliable.

BEST MODE FOR CARRYING OUT THE INVENTION

Figure 1:
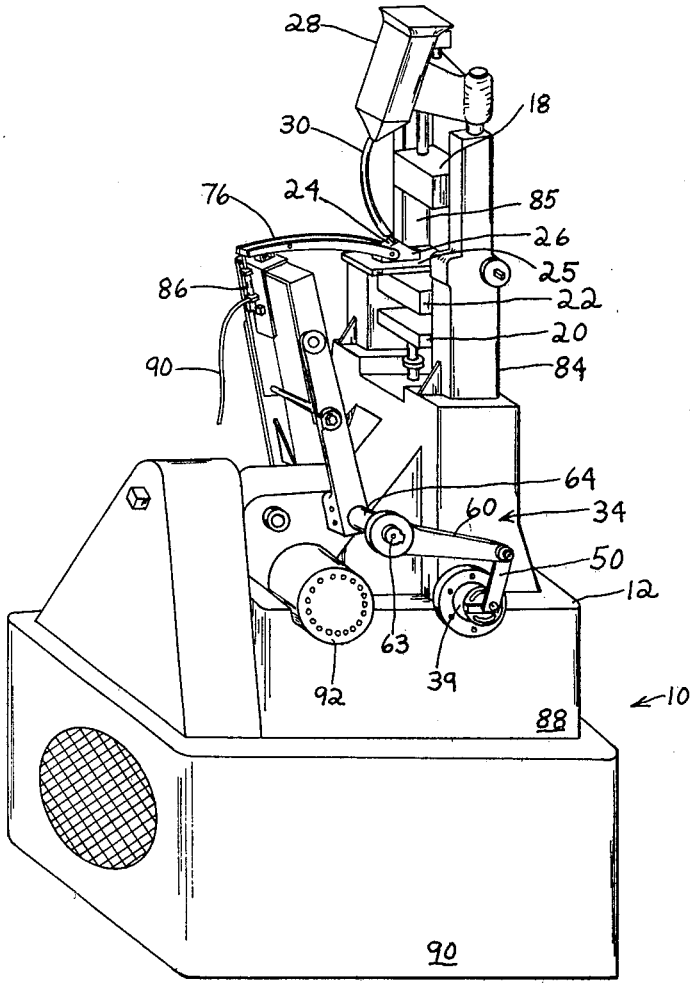
FIG. 1 is an isometric view of a press incorporating the invention therein.
Figure 2:
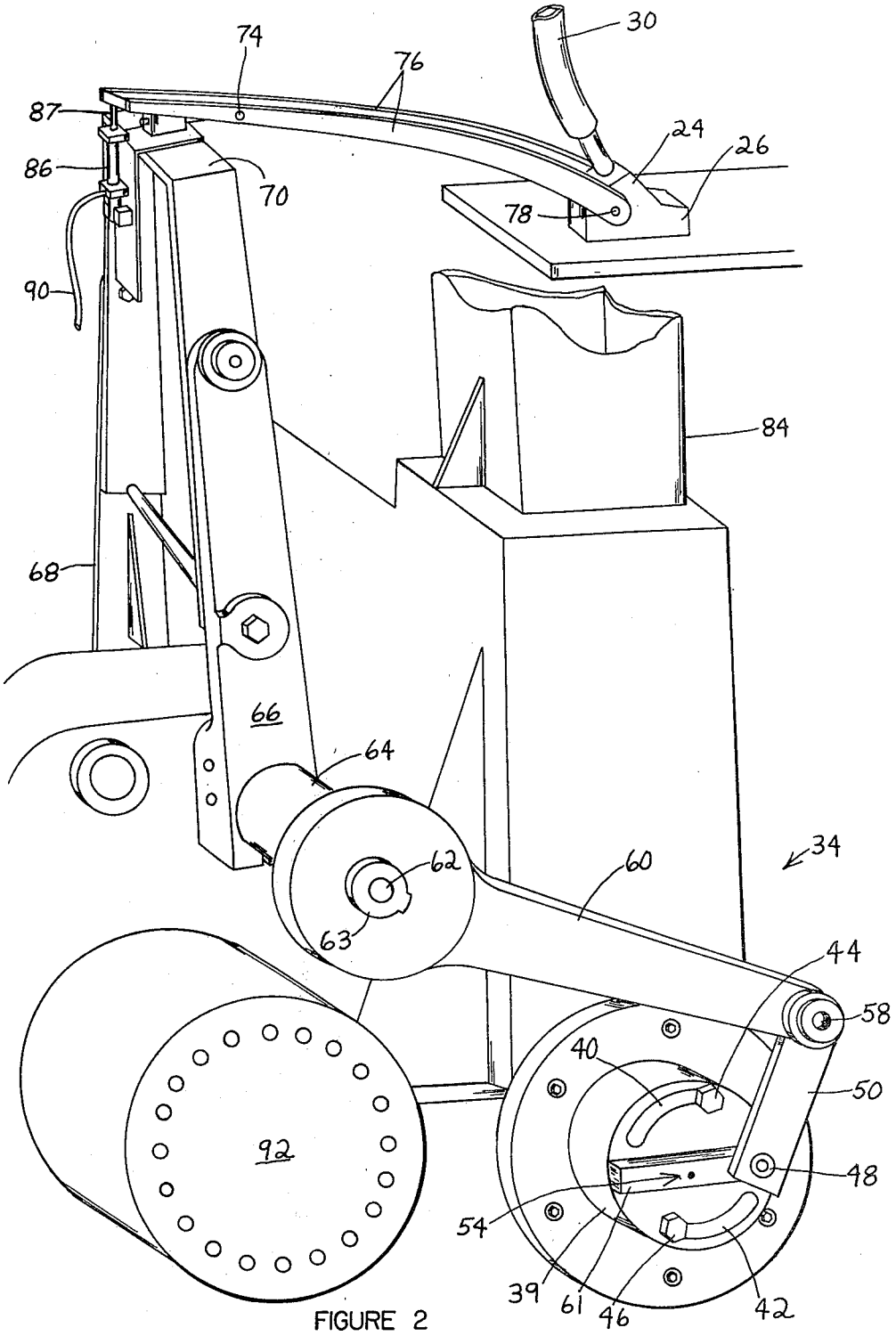
FIG. 2 is an enlarged isometric detaled view of the crank arm and associated drive mechanism.

Referring to FIGS 1 and 2, a ceramic compacting press is designated generally by reference numeral 10, and includes a base 90, pedestal 88, press bed 12, stanchions 84, 85, and press head 18. The press head 18 is vertically moveable relatively to a fixed die 20 having a die cavity therein. A shuttle 24 is slideably mounted on a moveable die 22. Shuttle 24 includes a shoe 26. The shoe receives a quantity of loose metal powder from the hopper 28 to the shoe 26. The shoe 26, upon movement over the die 22, will displace the briquette after it is formed and thereby eject the briquette from the press head 18. One mode for carrying this out is disclosed in "APPARATUS AND METHOD FOR PRODUCING UNIFORM DENSITY AND WEIGHT BRIQUETTES," invented by Stephen Burry, Application Ser. No. 156,387 filed June 4, 1980 commonly assigned. A flexible line 30 connects hopper 28 to the shoe 26. A bell crank 34 is driven by a power shaft (not shown) to which is positively coupled adapter plate 39 having arcuate recesses 40, 42. The angular position of the plate 39 determines the amplitude of movement of the shoe 26 and constitutes an important part of the present invention.

The crank arm member 50 is connected to adapter plate 39 to effect the desired movement of the shoe 26 and the shuttle 24. Pivot connection 48 between the crank arm member 50 and plate 39 is fixed to a raised portion 61 of plate 39. The circumferential position of plate 39 with respect to the power shaft controls the phase movement of the shuttle 24. The amplitude or degree of longitudinal maximum movement in first one direction and then the other is determined by the position of the pivot 48 relative to the center of rotation 54 in FIG. 2. This in turn is made adjustable if desired by slotting the connection between the crank arm member 50 and plate 39 through selective displacement of the distance from axis 54 to pivot connection 48.

Figure 3:
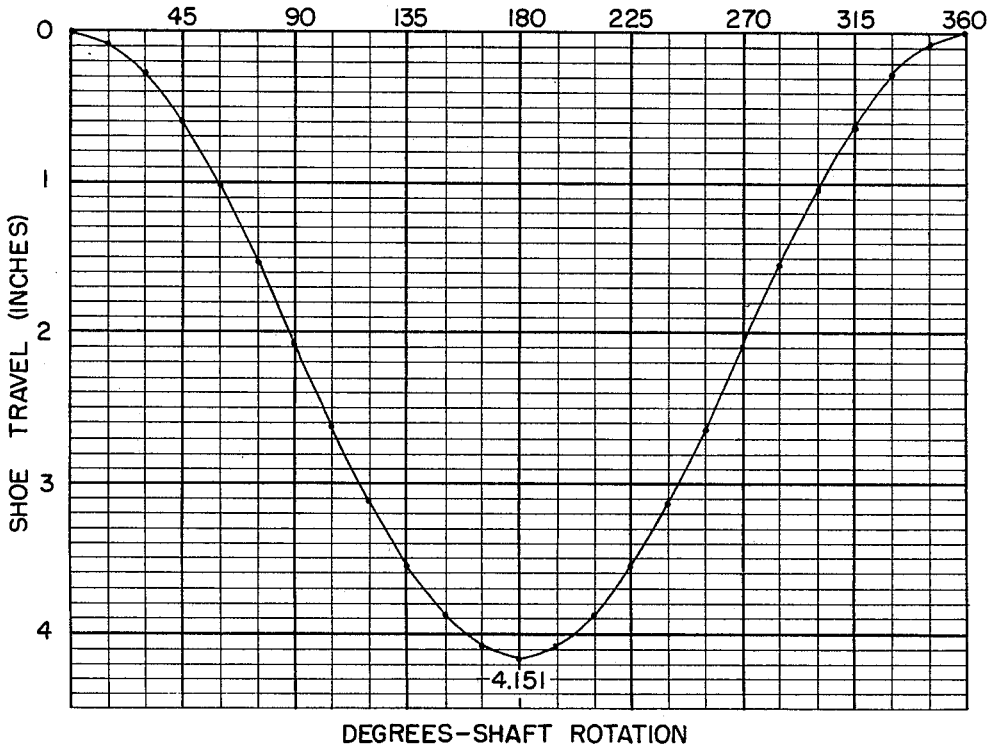
FIG. 3 illustrates the degree of Power Shaft Rotation vs. Shuttle Movement, the sinusoidal curve being that obtained in the present invention with the mechanism illustrated in FIGS. 1 and 2.

During the displacement of the shoe and shuttle, as tracked in FIG. 3, the shoe pushes the formed briquette from the bed of the press after it is raised out of the die cavity at the end of the compression stroke. The stroke of the shoe, and its range, constitutes an important improvement in operation. The prior art method of controlling the stroke entailed a cam drive, but this is totally unsatisfactory for two reasons—the cams were exposed surfaces which introduced destructive elements of wear brought on by exposure to dust and ceramic particles and the adjustment was difficult to obtain readily and accurately.

In the present invention, the sinusoidal movement together with totally protected bearings, reduces wear to an acceptably low level. At the same time, the range of movement, and the timing of shuttle movement is obtained with ready adjustments.

Referring to FIG. 2, the crank arm member 50 is secured through pivot 58 to crank arm member 60. Crank arm member 60, in turn, is keyed to a rocker shaft 63 and secondary crank shaft 62 operatively drives a rocker shaft 64. Rocker shaft 64 in turn operates the two rocker arms 66 and 68.

At the upper end 70 of rocker arms 66, 68 is a pivot mounting 74 for struts 76, having hinge connection 78 with the shuttle 24. The struts 76 are biased about-pivot 74 by means of a power cylinder 86 having a piston rod 87 connected to the struts 76. Power cylinder 86 is operated hydraulically through pressure line 90. The purpose of biasing struts 76 downwardly is that the shoe and struts will bear against the platen surface 25 of the press and will not be biased upwardly during reciprocable movement of the shuttle 24 caused by the bell crank 34, rocker shaft 64, rocker arms 66, 68 as before described.

The dies 20, 22 and press head 18 are mounted on two spaced stanchions 84, 85, the stanchions, in turn, being mounted on a pedestal 88 and base 90.

Also mounted on the press bed 12 is a motor 92 with a power take-off (not shown) connecting to a power shaft which in turn drives the bell crank 34 in the manner previously described through the power shaft and adapter plate 39.

Operation

In operation, the adapter plate 39 is adjusted by loosening the bolts 44, 46, and rotating the plate together with the pin attachment with crank arm member 50 in order to regulate the phase of operation for the shoe 26 and shuttle 24. Also, the length of stroke may be adjusted by simply changing the location of the pin connection 48 relative to the axis of rotation 54.

The motor 92 drives the power shaft to which is attached the adapter plate 39. As the plate 39 turns, the crank 50 acting through pivot 58, imparts a rotary movement to the crank arm member 60. The crank arm member 60 being keyed to the rocker shaft 64, causes the rocker shaft 64 and attached rocker arms 66, 68 to move in a back-and-forth direction. The back-and-forth movement imparts reciprocable movement to the shuttle 24 and shoe 26 through struts 76.

After powder derived from hopper 28 and transferred through the line 30 and shoe 26 fills the die cavity, the shuttle 24 is retracted, the die closes, and a briquette is produced. The press then raises the finished briquette out of the die cavity, the shuttle 24 reverses direction and moves the finished briquette away from the cavity, and the die cavity is refilled with powder from the shoe 26 in the manner previously described. Back-and-forth movement of the shoe and shuttle is coordinated with the closing and opening movements of the press head 18 and the die cavity so that briquettes are successively made and then removed in coordinated movements relative to the press.

The press 10 may be outfitted with different size die cavities for different size briquettes from time to time. Therefore, it is necessary in this operation to provide a different range of movement for the shuttle, and to adopt the phase of movement of the shuttle so that shuttle movements are accurately coordinated with die operation. Both of these are accomplished by simply selectively locating the pivot connection 48 of the crank arm member 50 relative to the axis 54 of the plate 39. Further adjustment in phase of oscillation is effected by angular adjustment of the plate 39 which determines the starting and stopping points for the dwell time, fill time, and reverse movements of the shuttle as previously described.

An important feature of the present invention is that all of the components of the press, as described, are sealed. With the cam arrangements previously relied upon as a means for translating the power movements of the power shaft to selective shuttle movements, exposed cam members became "dusted" with ceramic powder, and this served as an abrasize material which greatly increased the incidence of wear and reduced the useful life of the needle bearings and other components used. In contrast with the previous mode of operation, the present invention utilizes all sealed bearings, and insures smoother operation of the shuttle, increasing the effective range of reciprocation, adjusting such range, and providing smooth transition between stop and start phases of movement of the shuttle as evidenced by FIG. 3.

CONCLUSION

Although the present invention has been illustrated and described in connection with the single example embodiment, it will be understood that it is not to be deemed limitative of the invention. It is reasonably to be assumed that those skilled in this art can make numerous revisions and adaptations of the invention, and it is intended that such revisions and adaptations will be included within the scope of the following claims as equivalents of the invention.

I claim:

1. In a briquetting press having a shuttle and a power shaft for oscillation of said shuttle, said shuttle being operatively secured to said power shaft and a rocker shaft, the improvement comprising an adapter plate disposed between said power shaft and shuttle, said rocker shaft operatively secured to said power shaft and moveable in opposite angular directions, means for adjusting said adapter plate circumferentially relatively to said power shaft to control the phase operation of the output from said power shaft, said shuttle being reciprocable with a characteristic rate, range and phase movement determined by the operative adjusted position of said adapter plate relative to said power shaft.

2. The apparatus in accordance with claim 1, including lever means and a press plate, said lever means operatively disposed between said shuttle and said rocker shaft, and means for biasing said lever to effect yieldable loading of said shuttle against the press plate.

3. The apparatus in accordance with claim 1, including a shoe carried by said shuttle and having inlet means for receiving a quantity of powder transferred by said shuttle and shoe into a die cavity of said press.

4. The apparatus in accordance with claim 1, in which the characteristic movement of said shuttle is sinusoidal.

5. The apparatus in accordance with claim 1, including sealed bearing means between said power shaft and said shuttle.

* * * * *

UNITED STATES PATENT OFFICE
CERTIFICATE OF CORRECTION

Patent No. 4,327,996 Dated May 4, 1982

Inventor(s) Steven L. Affolder

It is certified that error appears in the above-identified patent and that said Letters Patent are hereby corrected as shown below:

Column 4, line 19 - delete "abrasize" and insert --abrasive--

In the Claims

Column 4, Claim 2, line 56 - after "lever" insert --means--

Signed and Sealed this

*Thirty-first* Day of *August 1982*

[SEAL]

*Attest:*

GERALD J. MOSSINGHOFF

*Attesting Officer*

*Commissioner of Patents and Trademarks*